US005397256A

United States Patent [19]

Bidwell

[11] Patent Number: 5,397,256

[45] Date of Patent: Mar. 14, 1995

[54] FLUSHING APPARATUS FOR BOAT MOTOR

[76] Inventor: Glenn P. Bidwell, 5221 SW. 8th Ct., Cape Coral, Fla. 33914

[21] Appl. No.: 272,603

[22] Filed: Jul. 11, 1994

[51] Int. Cl.[6] ..... B63H 21/10

[52] U.S. Cl. ..... 440/88; 134/167 R

[58] Field of Search ..... 440/88.113, 900; 134/167 R, 199

[56] References Cited

U.S. PATENT DOCUMENTS

| | | | |
|---|---|---|---|
| 4,246,863 | 1/1981 | Reese | 440/88 |
| 4,359,063 | 11/1982 | Carlson | 134/167 |
| 4,540,009 | 9/1985 | Karls | 134/167 |
| 4,973,276 | 1/1990 | Maurelis | 440/113 |
| 5,051,104 | 9/1991 | Guhlin | 440/88 |

*Primary Examiner*—Jesus D. Sotelo
*Attorney, Agent, or Firm*—Ira S. Dorman

[57] ABSTRACT

Apparatus for flushing a marine engine employs clamping members that operate hydraulically to engage the opposite sides of the engine housing, positioned over water intake ports thereof. Upon full engagement of the apparatus, a check-valve opens to permit water to flow through a clamping member and into the housing.

12 Claims, 5 Drawing Sheets

FLUSHING APPARATUS FOR BOAT MOTOR

BACKGROUND OF THE INVENTION

Apparatus for flushing cooling systems of marine engines are well known in the art, and are commercially available. Typically, such apparatus employs two heads, or sealing members, mounted in confronting relationship on a bracket for disposition over the cooling water intake ports of the engine housing. The heads (or at least one of them) are adapted to receive fresh water and direct it through an underlying intake port; mechanical means is conventionally employed to hold the heads in place.

Representative of the prior art on engine-flushing assemblies of the kind described are the following U.S. patents: U.S. Pat. No. 4,246,863, issued Jan. 27, 1981; No. 4,359,063, issued Nov. 16, 1982; No. 4,540,009, issued Sep. 10, 1985; No. 4,973,276, issued Nov. 27, 1990; and No. 5,051,104, issued Sep. 24, 1991.

SUMMARY OF THE INVENTION

Despite the level of activity indicated by the foregoing, a need remains for apparatus for flushing the housing of motorboat engines (inboard and outboard), which apparatus is conveniently located and placed upon the housing in an optimal operative position and has means for securely maintaining it in such position during the flushing operation. Accordingly, it is the broad object of the present invention to provide novel apparatus that satisfies the above-noted need.

More specific objects of the invention are to provide novel apparatus having the foregoing features and advantages, which is in addition of relatively incomplex design and construction, is relatively facile and economical to manufacture, and is yet highly effective for its intended purpose and convenient to use.

It has now been found that the foregoing and related objects of the invention are attained by the provision of apparatus that includes a frame, constructed for disposing a pair of clamping members on opposite sides of a motorboat engine housing, and first and second clamping members mounted on the frame in mutually confronting relationship. At least the "first" clamping member includes hydraulic expansion means that is extensible toward the "second" clamping member, for clamping the apparatus upon an engine housing disposed between them, and at least one of the clamping members includes water-delivery means so constructed and positioned as to enable the establishment of water-flow communication with a water-intake port of the engine housing. The apparatus further includes means for connecting a water-supply conduit to the expansion means, for effecting extension thereof, as well as to the delivery means for supplying water thereto, thereby enabling the apparatus to be engaged hydraulically upon a marine engine housing and employed for flushing thereof.

The means for connecting will advantageously include a value mechanism that is operative to permit water flow to the delivery means only when extension of the expansion means has been arrested. The clamping members may for example be hydraulic piston units; preferably however they will take the form of inflatable bladders having resiliently deformable inner elements for conforming to the underlying surfaces of the engine housing. In especially preferred embodiments the apparatus will additionally include an elongate handle for manipulating the frame from a remote position, the handle comprising a component of the water-connecting means, as may be realized by the use of hollow, tubular members.

DETAILED DESCRIPTION OF THE PREFERRED AND ILLUSTRATED EMBODIMENTS

Figure 1:
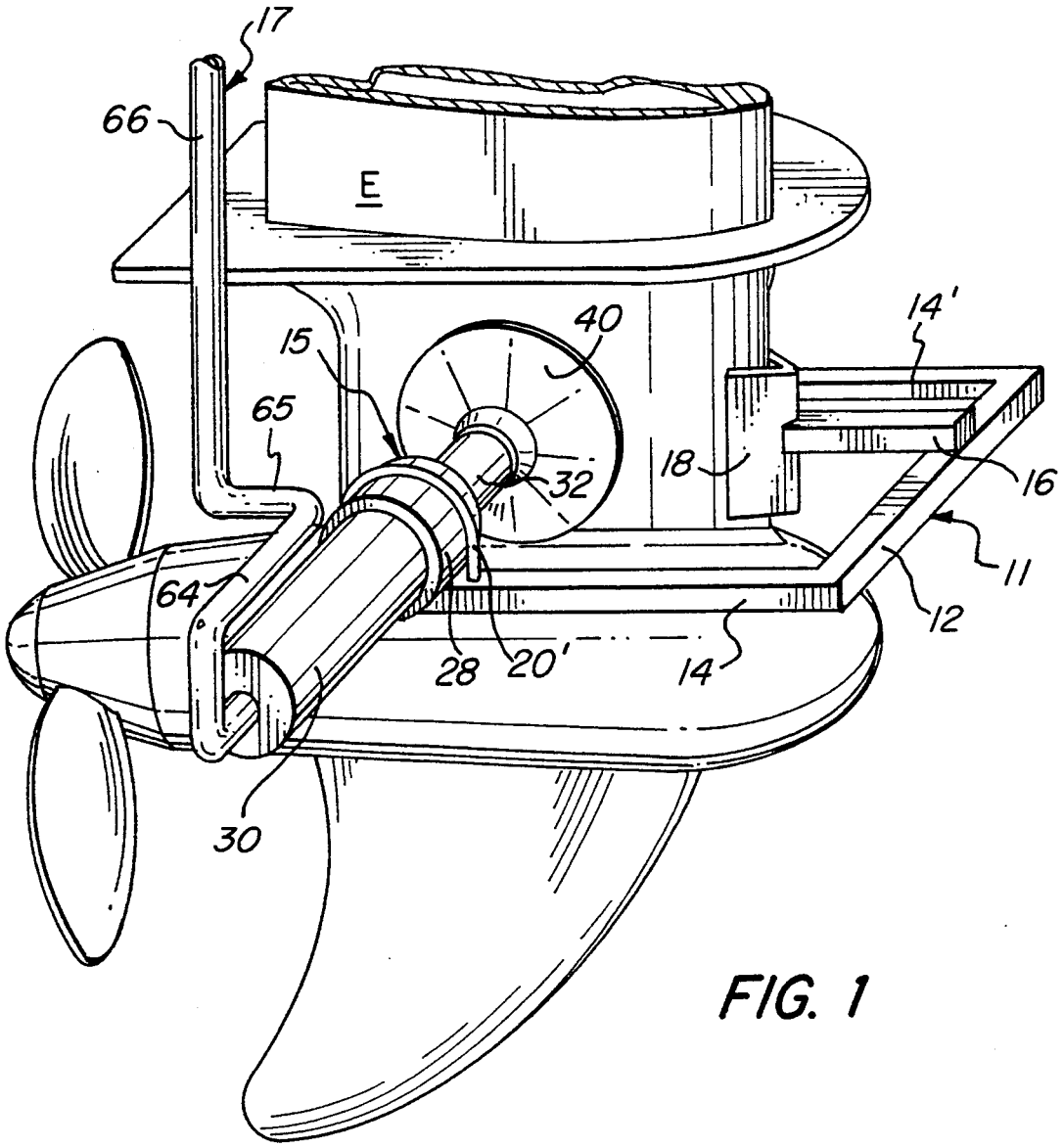
FIG. 1 is a perspective view of apparatus embodying the present invention, installed on the housing of a motorboat engine.
Figure 2:
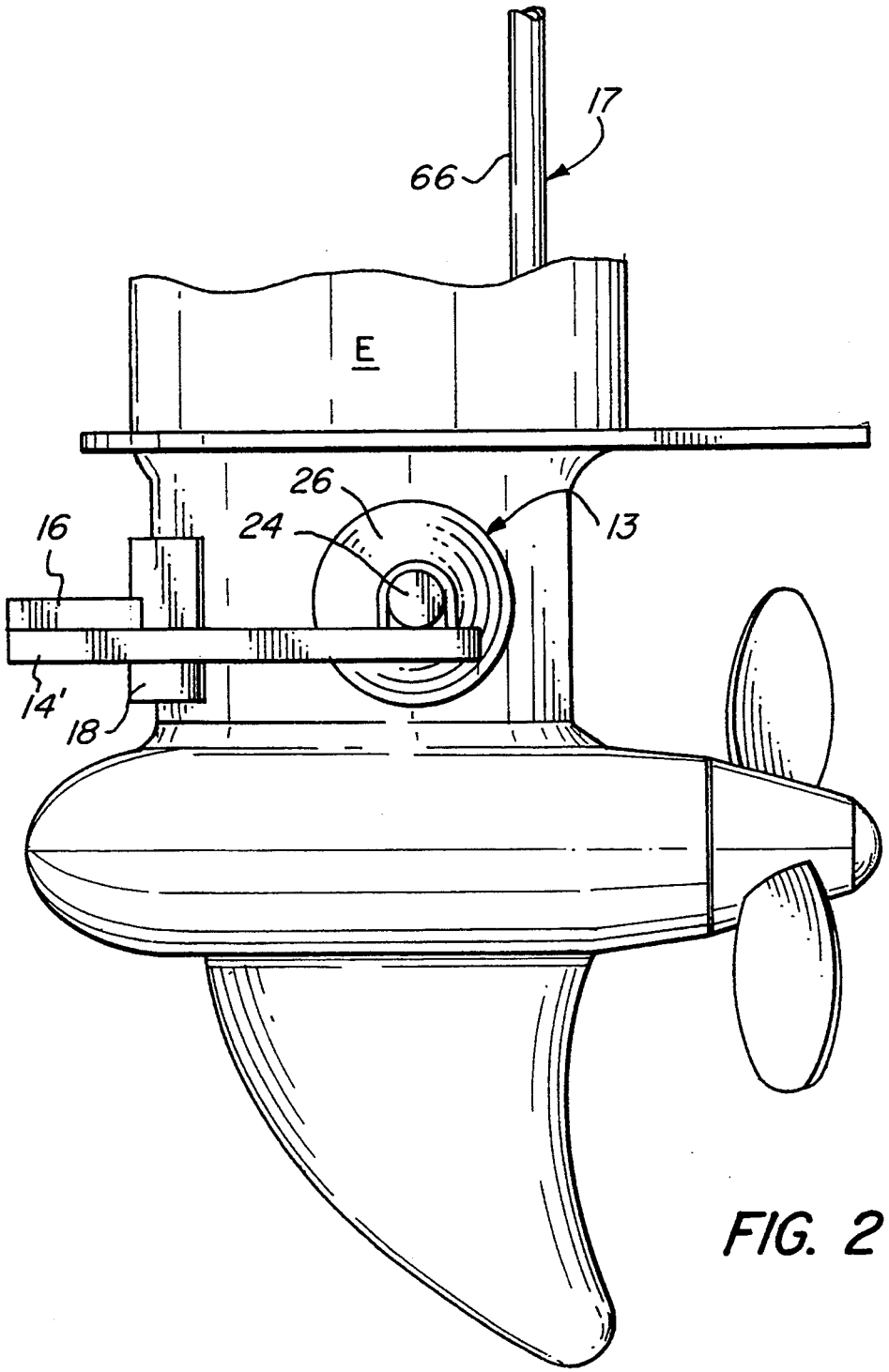
FIG. 2 is an elevational view of the same apparatus and housing, taken from the side opposite to that of FIG. 1.
Figure 3:
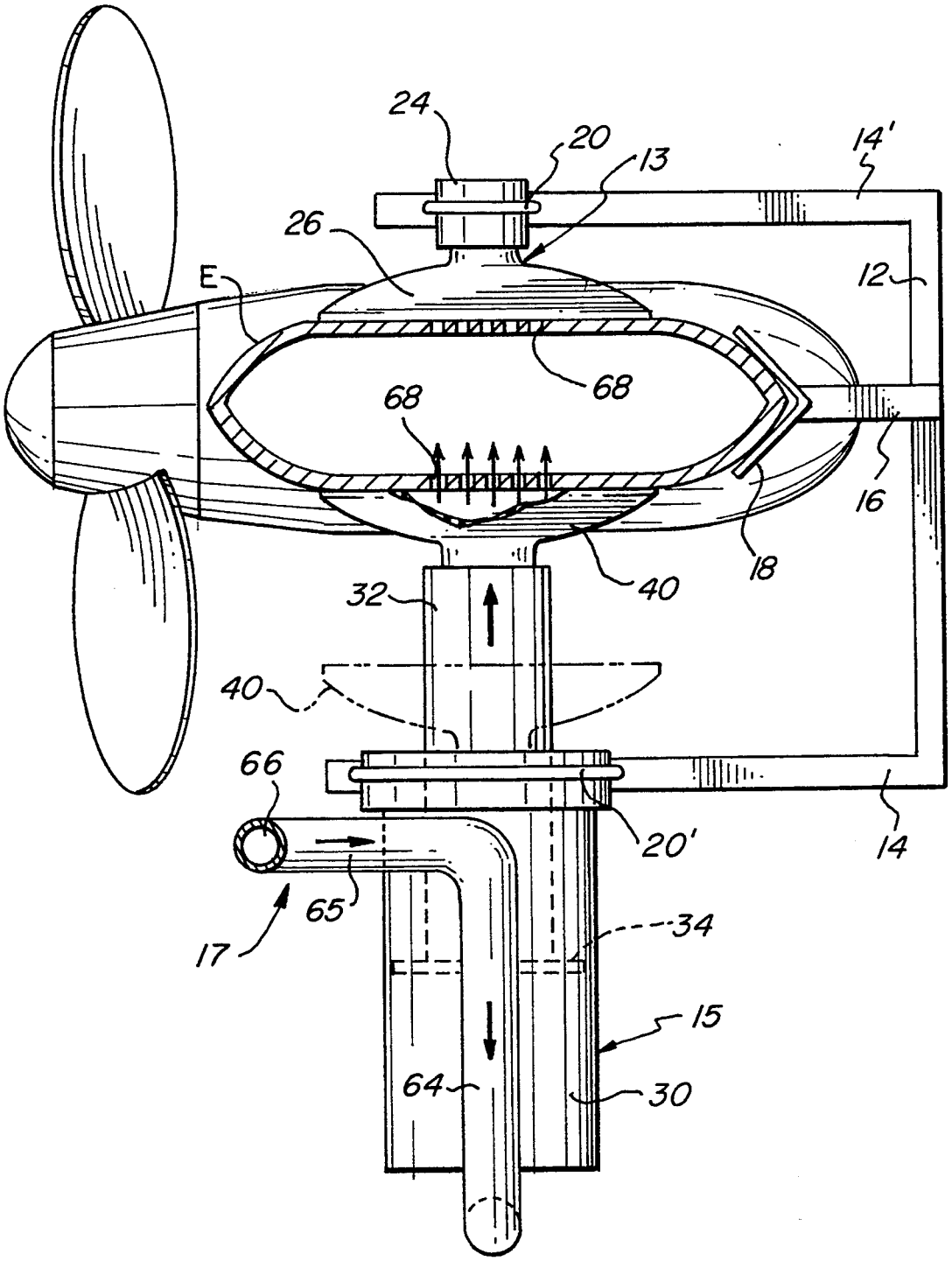
FIG. 3 is a plan view of the apparatus and housing, taken in partial section on a horizontal plane.

Turning initially to FIGS. 1 through 4 of the appended drawings, therein illustrated is flushing apparatus embodying the present invention and comprised of a bracket, two clamping members, and a handle assembly, generally designated respectively by the numerals 11, 13, 15, and 17. The bracket 11 is of generally U-shaped configuration and consists of a cross piece 12, arm pieces 14, 14' extending parallel to one another from opposite ends of the cross piece, and a short, central arm 16 which extends forwardly and supports on its inner end a V-shaped locating piece 18; the apparatus is installed with the locating piece 18 engaging the rearward edge of the housing of the engine "E".

One clamping member 13 is of fixed configuration and is mounted upon the arm 14' of the bracket 11. It consists essentially of a mounting piece 24 and a gripping cup 26, the cup 26 being received within the mounting piece 24 and typically being fabricated from a natural or synthetic elastomeric, resiliently deformable material; a clip 20 is used to secure the clamping member 13 to the arm 14'.

The expansible clamping member 15 comprises an hydraulic piston assembly, and includes a cup-shaped mounting piece 28 held in position upon the arm 14 of the bracket 11 by a mounting clip 20'. The open end of a cylinder 30 is engaged within the mounting piece 28, and a cylindrical piston body 32 is received coaxially within the chamber 33 of the cylinder 30 for reciprocal, sliding movement. An end plate 34 on the piston has an aperture 36 therein leading to the interior 35 of the body 32; a coil spring 38 bears at one end upon the plate 34 and acts upon the mounting piece 28 to urge the piston toward its retracted position within the cylinder 30.

A gripping cup 40 is mounted on the opposite end of the piston body 32 by affixing a stem portion 42 of the cup 40 within the forward, open end of the body. A bore 44 extends axially through the cup 40, and provides fluid flow communication between its opposite ends.

The body 46 of a ball valve is disposed within the piston body 32 and has a central passage 48 in which a ball 50 is slidably received. An enlarged portion at the inner end of the passage 48 defines an opening 52 and a valve seat element 54, against which the ball 50 is urged by a second coil spring 56. An adjustment nut 58 is engaged within a threaded portion 60 at the opposite end of the valve body 46, and serves to adjust compression of the spring 56 and thereby the closing force applied to the ball 50.

The handle assembly 17 consists of pipe sections 64, 65 and 66, fixed to one another and engaged within an opening 67 through the end wall 71 of the cylinder 30. The assembly 17 is of sufficient strength and rigidity to support and enable facile manipulation of the flushing apparatus, as well as providing a conduit for the flow of water; section 66 has coupling means (not shown) operatively disposed on its upper end, for connecting a water-supply hose.

As will be readily appreciated, the apparatus is installed upon the engine of a water-borne boat by using the handle assembly 17 to lower it into the water and to bring it into proper position; i.e., with the locating piece 18 engaged as illustrated in the figures. Once that has been accomplished, commencement of flow through the handle assembly will cause water to enter the chamber 33 of the cylinder 30 and to bear upon the end plate 34 of the piston, thereby urging the piston forwardly against the force of spring 38. Upon engagement of the side of the housing "E" movement of the gripping cup 40 will of course be arrested, causing water pressure to build in the piston chamber 35 as well as in the cylinder chamber 33. When the pressure reaches an appropriate value (e.g., 4–5 p.s.i.), the ball 50 will be forced away from the valve seat element 54 against the counteracting force of spring 56, thereby permitting water to flow through the opening 52 and passage 48, exiting through the bore 44 of the cup 40 and ultimately passing into the housing of the engine "E" through the ports 68 provided therein. This will of course effect flushing of the space within the housing by fresh water introduced through the handle assembly 17, while the clamping members 13 and 15 cooperatively hold the assembly securely in place.

Figures 4, 5:
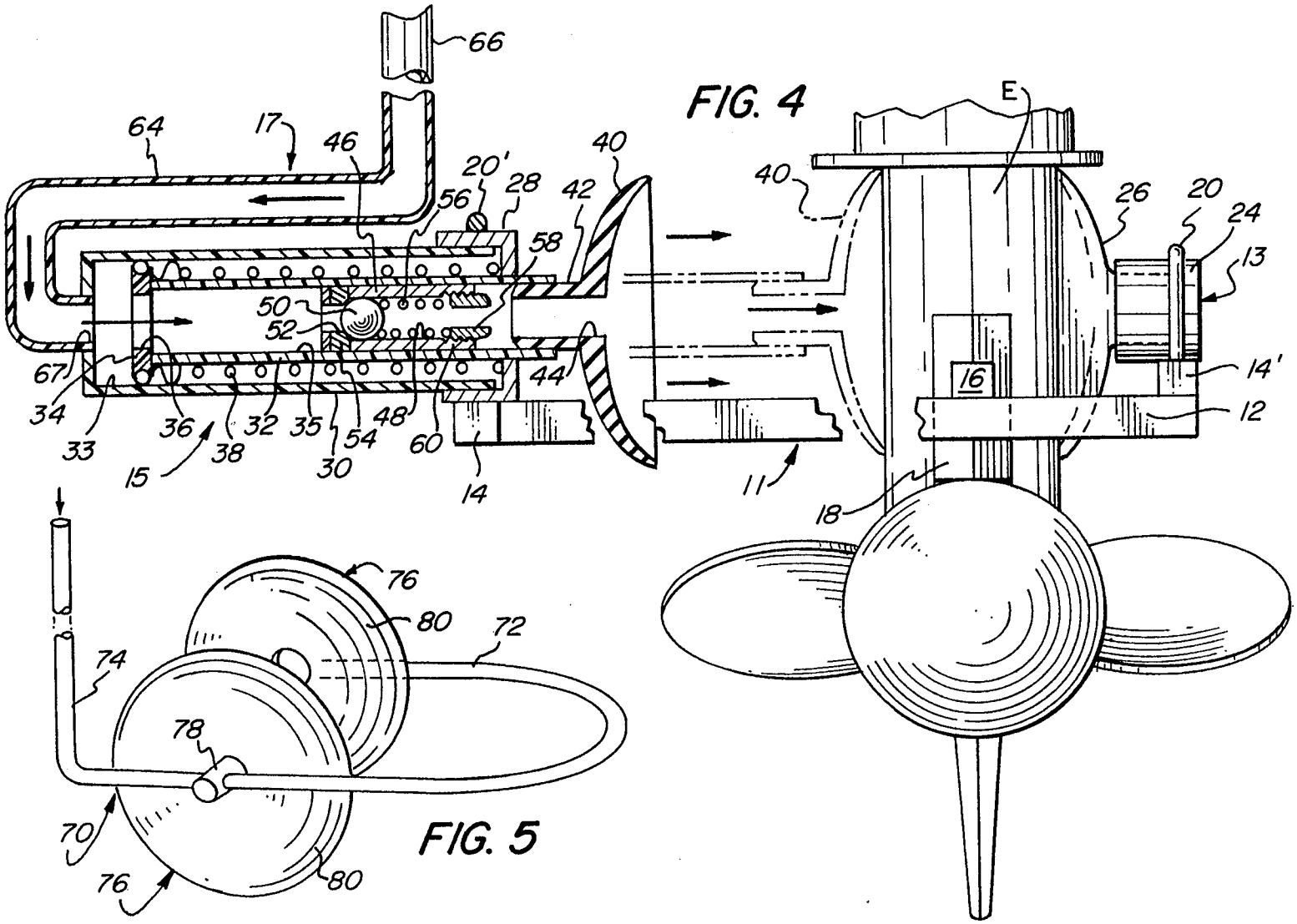
FIG. 4 is a back end view of the apparatus and housing, showing a movable clamping member in retracted (full-line) and extended (phantom-line) positions.
FIG. 5 is a perspective view showing a second form of apparatus embodying the present invention.
Figure 7:
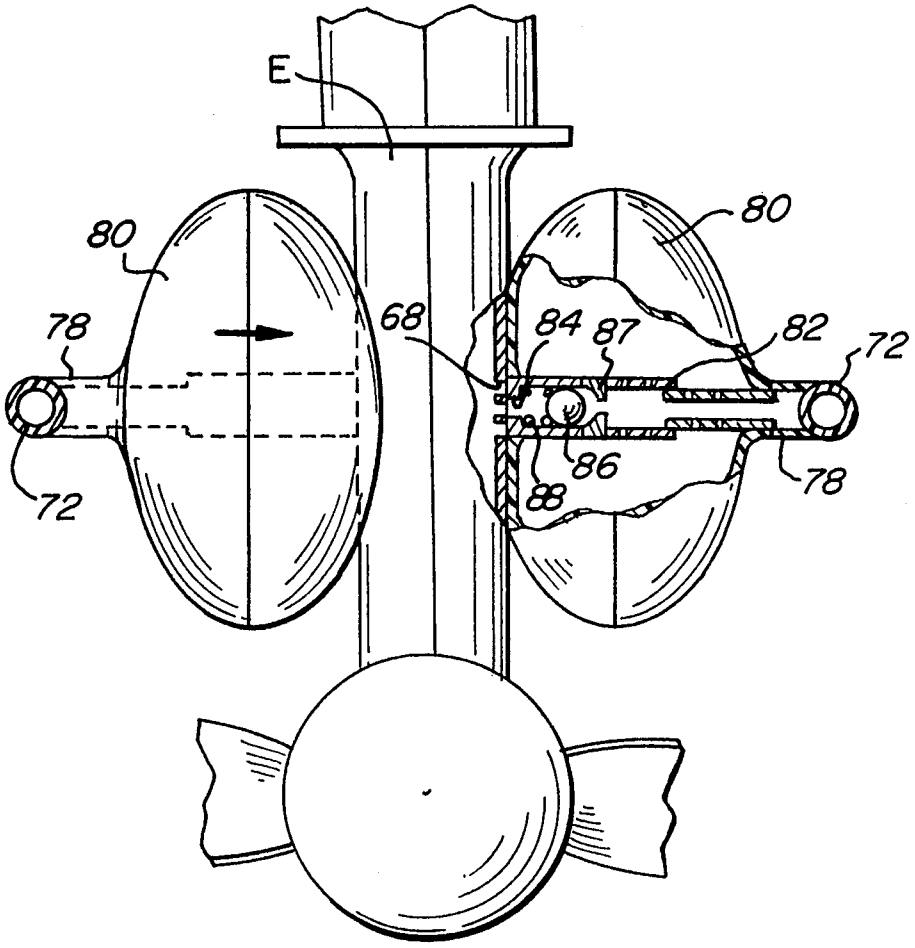
FIG. 7 is a view similar to FIG. 6, showing the clamping members expanded and extended into engagement on the opposite sides of the engine housing.
Figure 6:
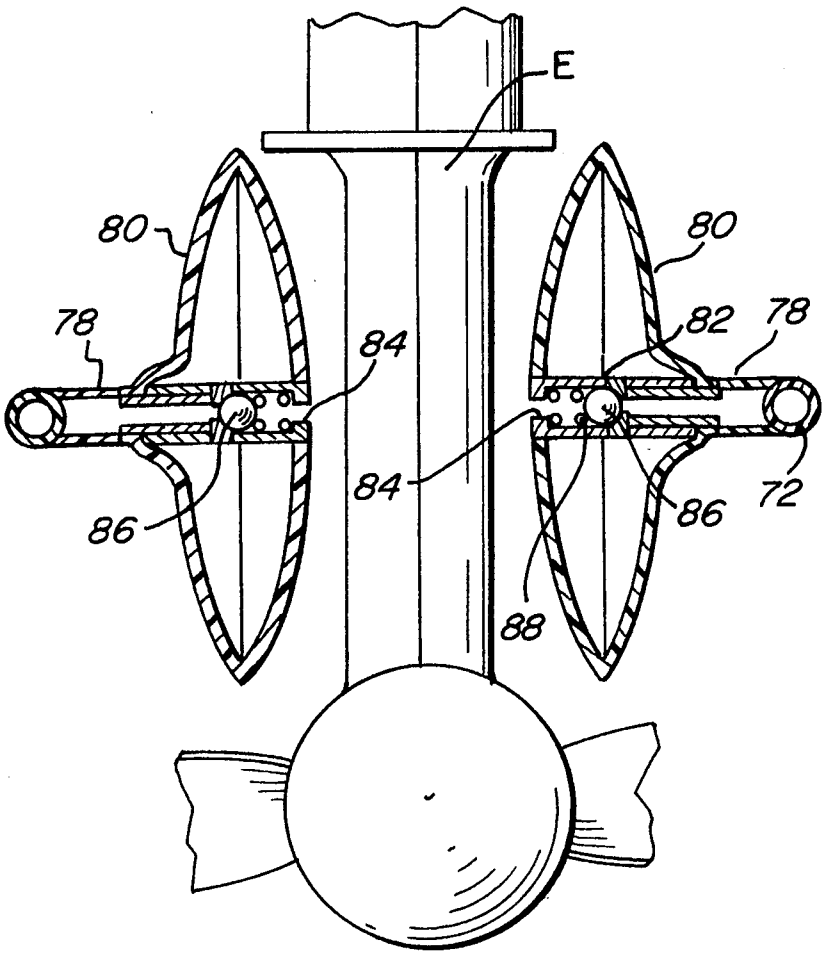
FIG. 6 is an end view of the apparatus of FIG. 5, fragmentarily illustrated and positioned and conditioned for installation on the motorboat engine depicted.

The apparatus depicted in FIGS. 5 through 7 functions similarly to that of the preceding figures; it is however of somewhat simpler, lighter weight, and more compact construction, while nevertheless being highly effective in operation. Accordingly, the form of apparatus shown in the these figures will, in many instances, constitute a preferred embodiment.

The apparatus consists of a handle assembly, generally designated by the numeral 70, having a U-shaped mounting portion 72 and a straight portion 74, the straight portion extending upwardly in the position of normal use and providing convenient means for holding and manipulating the apparatus. A pair of clamping members, each generally designated by the numeral 76, are disposed in confronting relationship on opposite sides of the U-shaped section 72 of the handle assembly, and include short, cylindrical coupling elements 78 in flow communication at one end with the tubular handle section 72. The elements 78 mount bladders 80 at their inner ends, which bladders 80 are fabricated from a resiliently deformable, natural or synthetic elastomeric material, permitting their expansion under water pressure.

As suggested in FIGS. 6 and 7, a valve assembly is contained within each bladder 80. It includes a tubular sleeve 82, which opens through an aperture 84 formed through the more inward of the two bladder walls, and a ball 86 which is slidably mounted within the sleeve 82 and biased by coil spring 88 into engagement with a seat element 87. In the position depicted in FIG. 6, water flowing through the piece 78 will pass about the sleeve 82 to fill the bladder 80, thereby effecting its expansion into engagement with the opposite surfaces of the housing of the engine "E" so as to produce the relationship shown in FIG. 7. Increasing pressure will then effect displacement of the ball 86 from the seat 87, thus permitting water to flow through the tube 82 and aperture 84, and ultimately to pass into the engine housing through the ports 68 provided.

It will be appreciated that modifications from the illustrated embodiments can be made to the apparatus of the invention without departing from the novel concepts hereof. For example, although the clamping members illustrated comprise hydraulic pistons and expansible bladders, other similarly functioning units can be substituted, as may take the form of bellows or the like. Moreover, and as noted above, both of the clamping members may receive water for extension into engagement with the motor housing, and both may serve for passage of water thereinto; alternatively, one or the other clamping member may serve either or both functions. Finally, it will be advantageous in certain instances to provide additional means for guiding the apparatus into operative position on the motor housing, which in one form may comprise a bearing element disposed for engagement on the cavitation plate of the engine.

Thus, it can be seen that the present invention provides novel apparatus for flushing the cooling system of a marine engine, which apparatus is conveniently located and placed upon the housing in an optimal operative position, and has means for securely maintaining it in place during the flushing operation. The apparatus is of relatively incomplex design and construction, is relatively facile and economical to manufacture, and is highly convenient and effective to use.

Having thus described the invention, what is claimed is:

1. Apparatus for flushing a marine engine housing, comprising:

a frame constructed for disposing a pair of clamping members mounted thereby on opposite sides of a marine engine housing;

first and second clamping members mounted in mutually confronting relationship on said frame, at least said first clamping member including hydraulic expansion means extensible toward said second clamping member for clamping said apparatus upon an engine housing disposed therebetween, and at least one of said clamping members including water-delivery means so constructed and positioned as to enable the establishment of water-flow communication with a water-intake port of an engine housing so disposed; and means for connecting a water supply conduit to said expansion means and said delivery means for effecting such extension of said expansion means and for supplying water to said delivery means, whereby said apparatus can be engaged hydraulically upon a marine engine housing and employed for flushing thereof.

2. The apparatus of claim 1 wherein said means for connecting includes a valve mechanism that is operative to permit flow of water to said delivery means only when extension of said expansion means is arrested.

3. The apparatus of claim 1 wherein said first clamping member is an inflatable bladder having a resiliently deformable inner element confronting said second clamping member, said inner element being capable of conforming substantially to the underlying surface of the engine housing when extended into contact therewith.

4. The apparatus of claim 1 wherein said hydraulic expansion means comprises an hydraulic piston unit.

5. The apparatus of claim 1 wherein said one clamping member is said first clamping member.

6. The apparatus of claim 1 wherein both of said first and second clamping members include said expansion means.

7. The apparatus of claim 1 additionally including elongate handle means for manipulating said frame from a remote position.

8. The apparatus of claim 7 wherein said handle means comprises said means for connecting a water supply.

9. Apparatus for flushing a marine engine housing, comprising:

a frame constructed for disposing a pair of clamping members mounted thereby on opposite sides of a marine engine housing;

first and second clamping members mounted in mutually confronting relationship on said frame, said clamping members comprising expansible, inflatable bladders having resiliently deformable inner elements capable of conforming substantially to the underlying surface of the engine housing when extended into contact therewith, and being extensible toward one another under hydraulic force for clamping said apparatus upon an engine housing disposed therebetween, at least one of said clamping members including water-delivery means so constructed and positioned as to enable the establishment of water-flow communication with a water-intake port of an engine housing so disposed; and means for connecting a water supply conduit to said bladders, for effecting such extension thereof, and to said delivery means for supplying water thereto, whereby said apparatus can be engaged hydraulically upon a marine engine housing and employed for flushing thereof.

10. Apparatus for flushing a marine engine housing, comprising:

a frame constructed for disposing a pair of clamping members mounted thereby on opposite sides of a marine engine housing;

first and second clamping members mounted in mutually confronting relationship on said frame, at least said first clamping member including hydraulic expansion means extensible toward said second clamping member for clamping said apparatus upon an engine housing disposed therebetween, and at least one of said clamping members including water-delivery means so constructed and positioned as to enable the establishment of water-flow communication with a water-intake port of an engine housing so disposed;

means for connecting a water supply conduit to said expansion means and said delivery means for effecting such extension of said expansion means and for supplying water to said delivery means, whereby said apparatus can be engaged hydraulically upon a marine engine housing and employed for flushing thereof; and elongate handle means for manipulating said frame from a remote position, said handle means comprising said means for connecting.

11. The apparatus of claim 10 wherein said means for connecting includes a valve mechanism operative to permit flow of water to said delivery means only when extension of said expansion means is arrested.

12. The apparatus of claim 11 wherein said hydraulic expansion means incorporates said valve mechanism, said one clamping member being said first clamping member.

* * * * *